US010196117B2

(12) United States Patent
Lichter et al.

(10) Patent No.: US 10,196,117 B2
(45) Date of Patent: Feb. 5, 2019

(54) AUTONOMOUS UNMANNED UNDERWATER VEHICLES

(71) Applicant: Lockheed Martin Corporation, Bethesda, MD (US)

(72) Inventors: Harry J. Lichter, Riviera Beach, FL (US); Wayne A. Baker, Riviera Beach, FL (US); Russell M. Sylvia, Marion, MA (US)

(73) Assignee: Lockheed Martin Corporation, Bethesda, MD (US)

( * ) Notice: Subject to any disclaimer, the term of this patent is extended or adjusted under 35 U.S.C. 154(b) by 33 days.

(21) Appl. No.: 15/272,048

(22) Filed: Sep. 21, 2016

(65) Prior Publication Data

US 2017/0081004 A1 Mar. 23, 2017

Related U.S. Application Data

(60) Provisional application No. 62/221,295, filed on Sep. 21, 2015.

(51) Int. Cl.
*B63G 8/00* (2006.01)
*B63G 8/08* (2006.01)
(Continued)

(52) U.S. Cl.
CPC ..... *B63G 8/08* (2013.01); *B63G 8/001* (2013.01); *B63G 8/14* (2013.01); *B63G 8/16* (2013.01);
(Continued)

(58) Field of Classification Search
CPC .... B63G 8/00; B63G 8/001; B63G 2008/002; B63G 2008/004; B63G 2008/005;
(Continued)

(56) References Cited

U.S. PATENT DOCUMENTS 4,809,630 A 3/1989 Walker
5,758,592 A 6/1998 Benson, Jr.
(Continued)

OTHER PUBLICATIONS

T. Joung et al., "Verification of CFD analysis methods for predicting the drag force and thrust power of an underwater disk robot," Int. J. Nav. Archit. Ocean Eng., (2014) vol. 6, p. 269-281.
(Continued)

*Primary Examiner* — Ajay Vasudeva
(74) *Attorney, Agent, or Firm* — Hamre, Schumann, Mueller & Larson, P.C.

(57) ABSTRACT

Autonomous underwater vehicles are described that are stackable with other like autonomous underwater vehicles on a suitable launch platform, such as within a vertical missile launch tube of a submarine, waiting to be deployed into the water. The underwater vehicles can be deployed or launched individually, in groups, or all together into the water. While stacked together, the stacked autonomous underwater vehicles can connect to one another or to external structure of the launch platform. In addition, the underwater vehicles can be positively buoyant or can be made to have controllable buoyancy to allow the underwater vehicles to float up and out of the launch platform during deployment without an external deployment force.

9 Claims, 16 Drawing Sheets

(51) Int. Cl.
*B63G 8/14* (2006.01)
*B63G 8/16* (2006.01)
*B63G 8/30* (2006.01)

(52) U.S. Cl.
CPC ..... *B63G 8/30* (2013.01); *B63G 2008/004* (2013.01); *B63G 2008/008* (2013.01)

(58) Field of Classification Search
CPC ..... B63G 2008/007; B63G 2008/008; B63G 8/08; B63G 8/14; B63G 8/16; B63G 8/30; B63G 8/32; B63G 8/34
See application file for complete search history.

(56) References Cited

U.S. PATENT DOCUMENTS 6,482,054 B2 11/2002 Treaster et al.
6,986,320 B2 1/2006 Shelton et al.
7,159,501 B1 * 1/2007 Ansay ..... F41F 3/052 114/316
8,887,614 B1 * 11/2014 Carreiro ..... B63G 8/30 89/1.809
9,227,709 B1 1/2016 Schill et al.
9,383,471 B2 * 7/2016 Tamanaja ..... G01V 1/3852
9,469,382 B2 * 10/2016 Lelaurin ..... G01V 1/3852
9,738,360 B2 8/2017 Habeger
10,106,233 B2 * 10/2018 Lichter ..... B63G 8/001
2009/0126619 A1 5/2009 Woolwright et al.
2011/0162573 A1 7/2011 Race et al.
2014/0078861 A1 3/2014 Tamanaja
2014/0177387 A1 6/2014 Brizard
2017/0081002 A1 3/2017 Lichter et al.
2017/0081005 A1 3/2017 Lichter et al.

OTHER PUBLICATIONS

International Search Report and Written Opinion for application No. PCT/US2016/052910, dated Dec. 8, 2016 (18 pages).

* cited by examiner

AUTONOMOUS UNMANNED UNDERWATER VEHICLES

FIELD

This disclosure relates to underwater vehicles, in particular autonomous underwater vehicles (AUVs) which may also be referred to as unmanned underwater vehicles (UUVs).

BACKGROUND

Various configurations of AUVs are known. Some are known to be cigar or torpedo shaped. Another known AUV is disk-shaped as described by Joung et al. in *Verification of CFD Analysis Methods For Predicting The Drag Force And Thrust Power of an Underwater Disk Robot.*

SUMMARY

Versatile unmanned underwater vehicles are described herein that can be used in a host of different applications and missions. Each of the unmanned underwater vehicles described herein is a vehicle that does not carry a human operator, and performs its operations autonomously and is not physically tethered to another vehicle by a mechanical tether. The unmanned underwater vehicles may also be referred to as autonomous underwater vehicles (AUVs) or unmanned underwater vehicles (UUVs).

In one embodiment, the underwater vehicles are stackable with other like underwater vehicles on a suitable launch platform waiting to be deployed into the water. One example of a suitable launch platform includes, but is not limited to, a vertical missile launch tube of a submarine where the underwater vehicles are stacked together within the vertical missile launch tube waiting to be deployed into the water. The underwater vehicles can be deployed or launched individually, in groups, or all together from the missile launch tube into the water, for example while the submarine is submerged under the water. While stacked together within the missile launch tube, the stacked underwater vehicles can connect to one another or to external structure of the launch tube. In addition, the underwater vehicles can be positively buoyant or can be made to have controllable buoyancy to allow the underwater vehicles to float up and out of the vertical missile launch tube during deployment without an external deployment force provided by the submarine.

In one non-limiting example, a rail structure can be provided in the missile launch tube. The underwater vehicles can be designed to interact with the rail structure to help hold the underwater vehicles in their stacked arrangement prior to deployment as well as facilitate deployment of the underwater vehicles from the missile launch tube. The underwater vehicles can be releasably secured to the rail structure. When it is time to launch the underwater vehicle, the releasable securement between the underwater vehicle and the rail structure can be automatically and remotely released (i.e. remotely and without direct human physical manipulation of the securing mechanism) to permit the underwater vehicle to be deployed.

The underwater vehicles can have any configuration that is suitable for allowing a plurality of the underwater vehicles to fit within, be stacked within, and be deployed from, the missile launch tube. The underwater vehicles described herein can be referred to as disk-shaped or pancake-shaped where each underwater vehicle can be considered generally disk-shaped or pancake-shaped with each underwater vehicle having a maximum lateral or maximum major dimension in side view that is significantly larger than its maximum thickness or height in side view. For example, in one non-limiting example, for each underwater vehicle, the maximum lateral dimension could be about 3-4 times greater than the maximum height.

The underwater vehicles are configured to permit 2 or more of the underwater vehicles to be stacked within the missile launch tube. In another embodiment, 3 or more of the underwater vehicles can be stacked within the missile launch tube. In one particular application, the underwater vehicles are configured to permit up to 15 of the underwater vehicles to be stacked within the missile launch tube. Of course, it is also possible to arrange a single one of the underwater vehicles in the missile launch tube.

In one embodiment, the underwater vehicle can be described as being disk-shaped with a maximum lateral or maximum major dimension in side view that is larger than its maximum thickness in side view. The underwater vehicle has a perimeter edge defining a curved leading edge, a curved trailing edge, a first linear or straight side edge interconnecting the curved leading edge and the curved trailing edge, a second linear or straight side edge opposite the first side edge and interconnecting the curved leading edge and the curved trailing edge, an upper surface, and a lower surface. The underwater vehicle includes a plurality of thruster for horizontal propulsion. For example, the underwater vehicle can include two propulsion thrusters for horizontal propulsion on the upper surface of the vehicle, with the two thrusters disposed on opposite sides of a principle axis extending between the curved leading edge and the curved trailing edge. The underwater vehicle can further include two propulsion thrusters for horizontal propulsion on the lower surface of the vehicle, with the two thrusters disposed on opposite sides of the principle axis. All of the horizontal thrusters are disposed within the boundary defined by the perimeter edge, i.e. the horizontal thrusters do not project beyond the perimeter edge. In addition, the underwater vehicle includes a single vertical thruster that extends vertically through the vehicle from the bottom surface to the top surface for vertical propulsion of the vehicle. A central axis of the vertical thruster intersects the principle axis.

DRAWINGS

Figure 4:
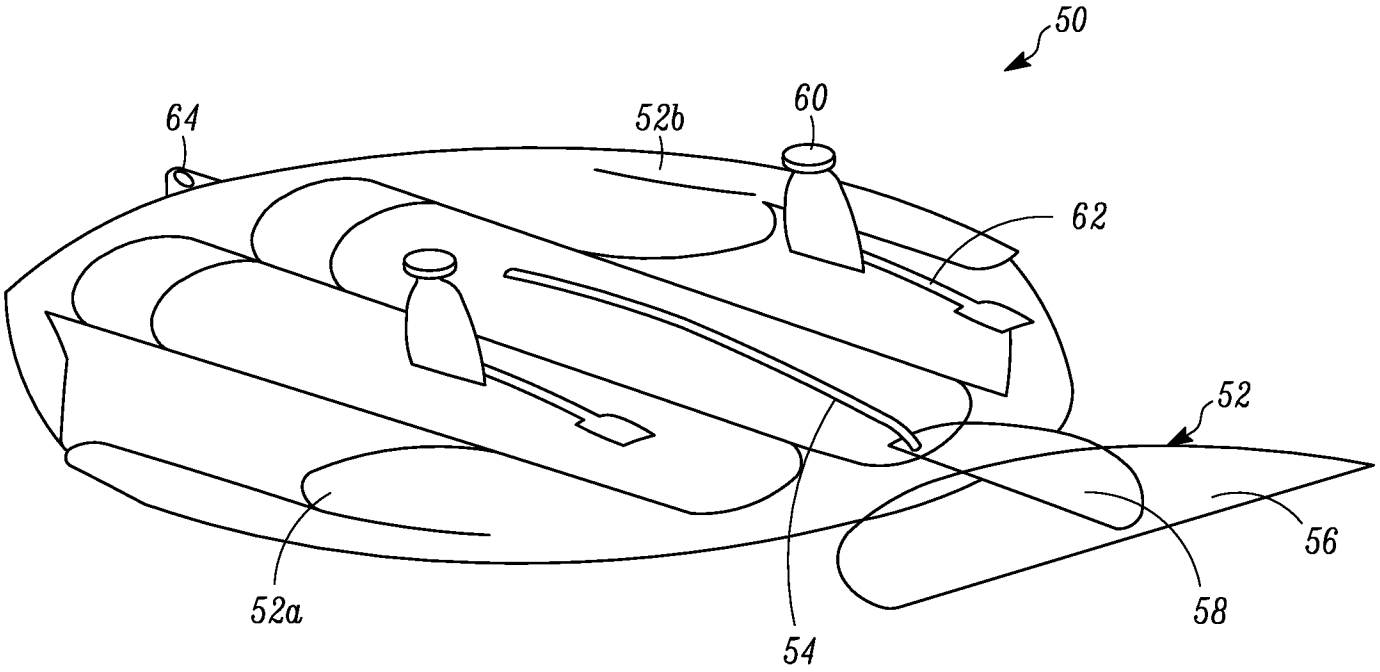
FIG. 4 is a perspective view of another example of an AUV described herein that includes a deployable tail to improve hydrodynamics.
Figure 5A:
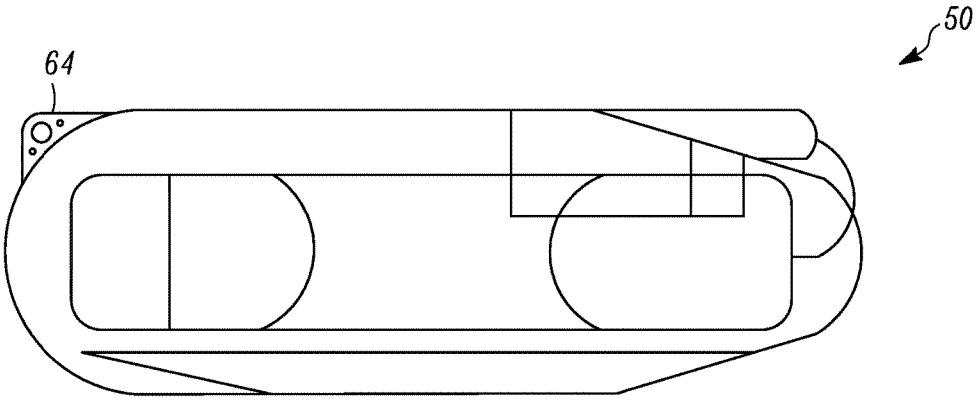

FIG. 5*a* is a side view of the AUV of FIG. 4 with the tail in the non-deployed position.

Figure 5B:
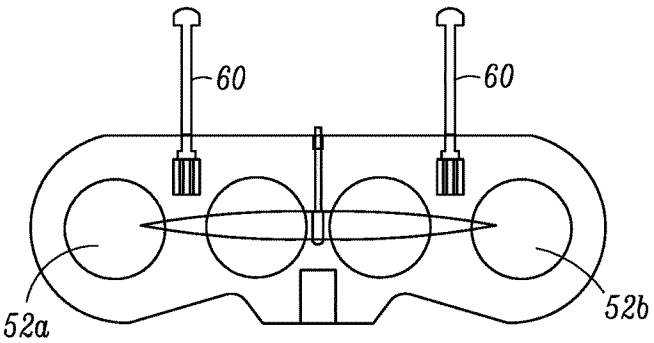

FIG. 5*b* is a rear view of the AUV of FIG. 4 with the tail in the deployed position.

Figure 6:
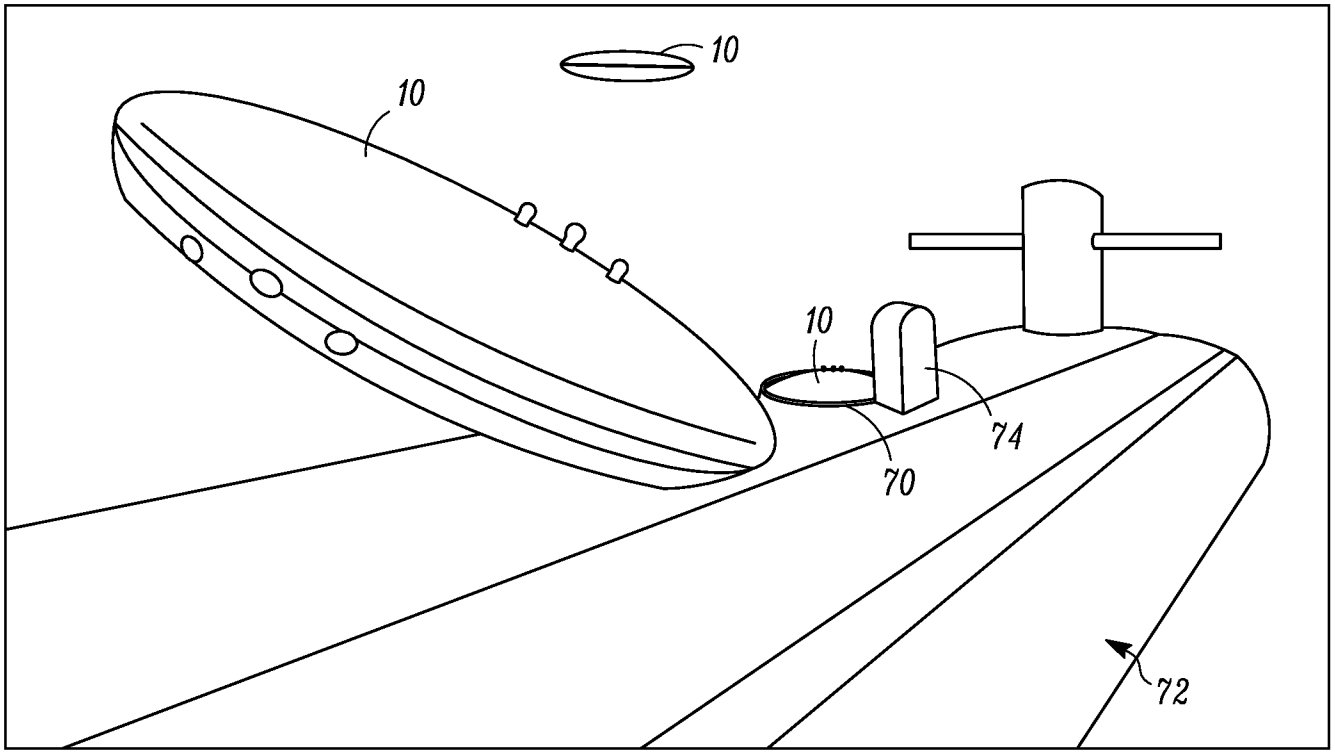

FIG. 6 illustrates a plurality of the AUVs being launched from a missile launch tube of a submarine.

Figure 7:
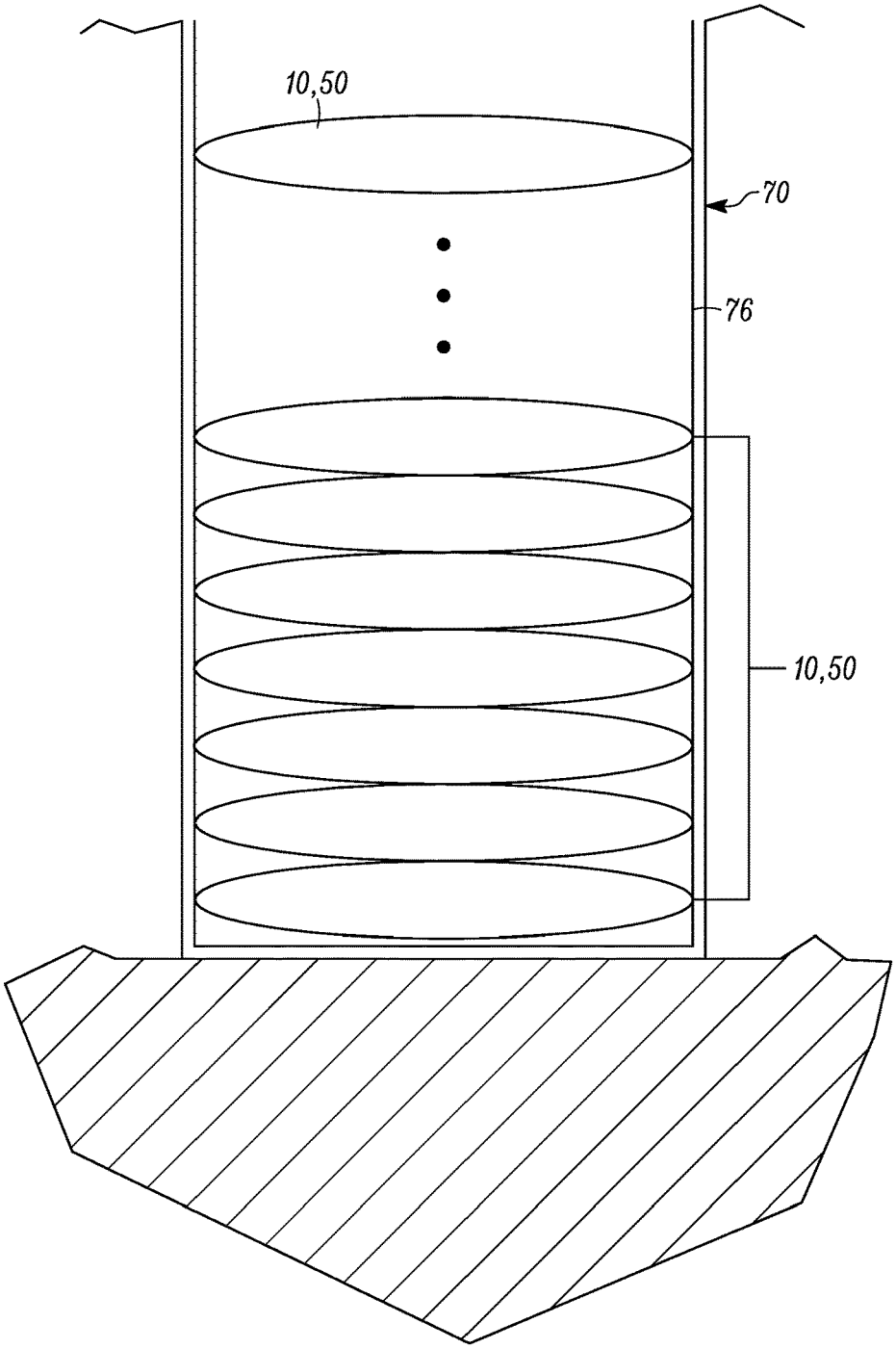

FIG. 7 is a side view of the missile launch tube showing a plurality of the AUVs stacked on top of one another.

Figure 8:
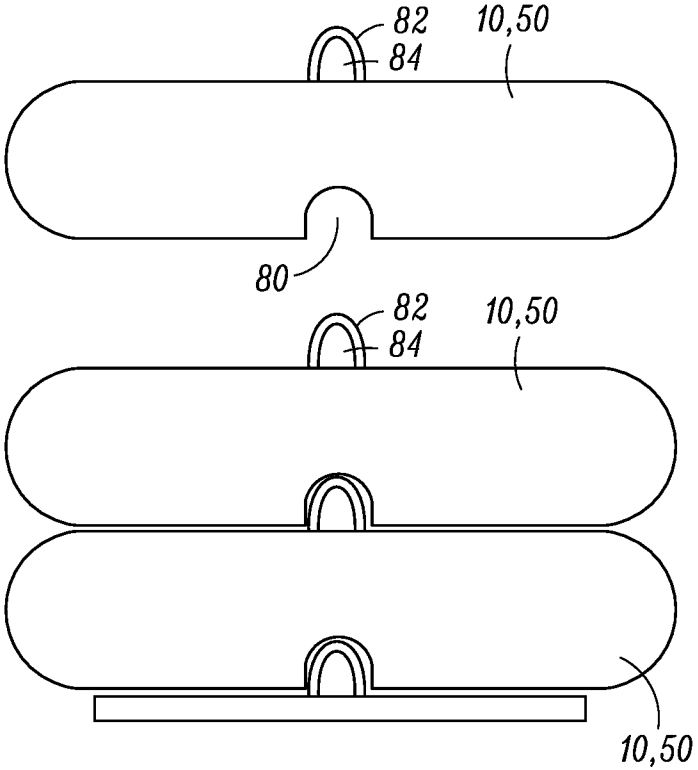

FIG. 8 is a side cross-sectional view of the stacked AUVs showing an example of a releasable connection mechanism between the AUVs.

Figure 9:
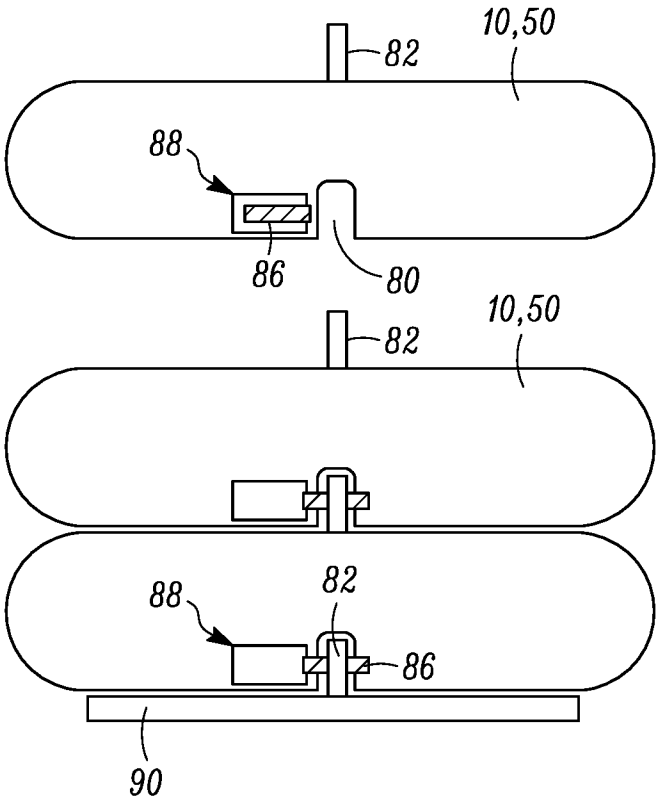

FIG. 9 is a side cross-sectional view similar to FIG. 8 but rotated 90 degrees.

Figure 10:
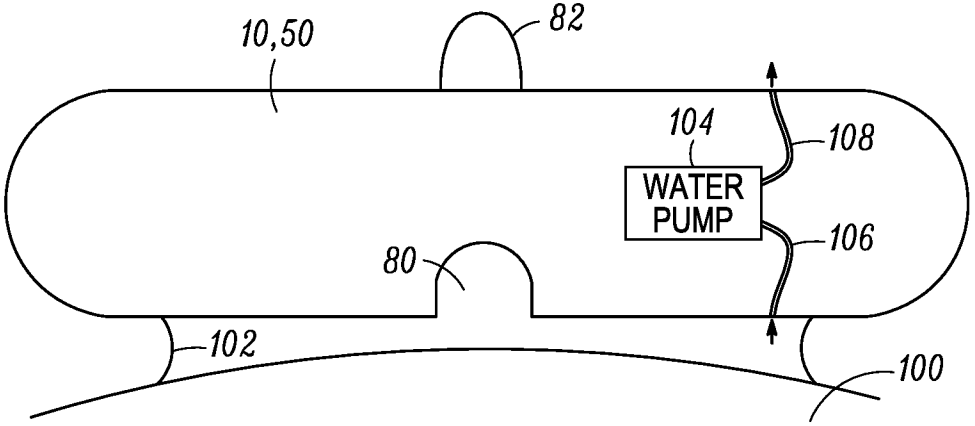

FIG. 10 is a side view of another embodiment of an AUV that includes a suction attachment mechanism thereon.

Figure 11:
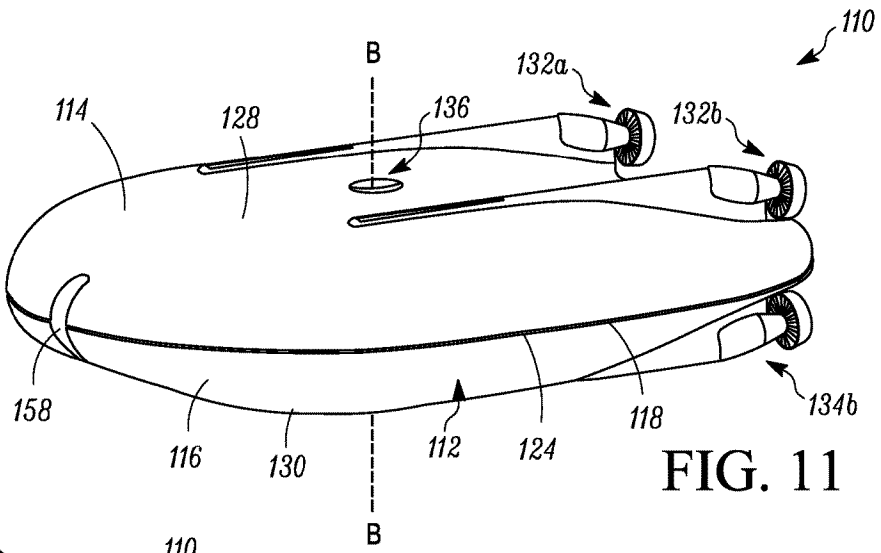

FIG. 11 is a perspective view of another embodiment of an AUV described herein.

Figure 12:
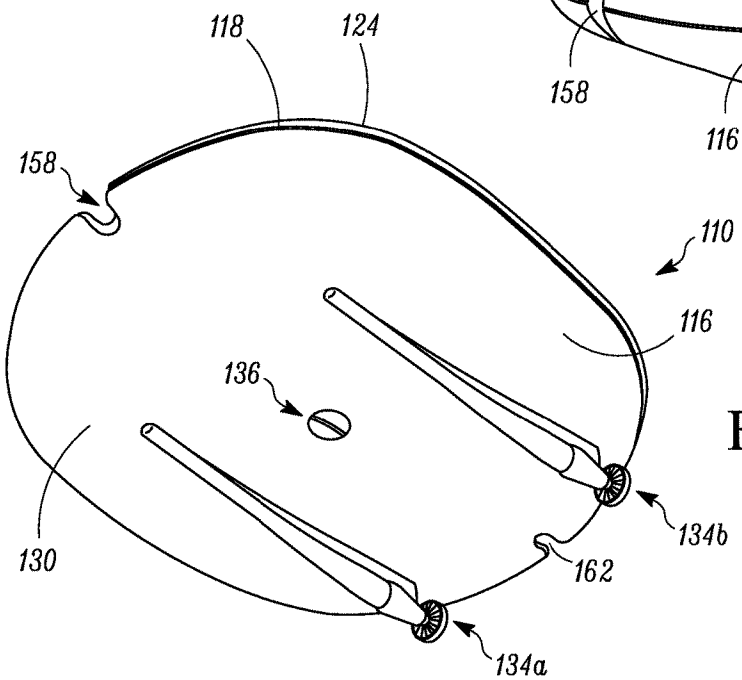

FIG. 12 is another perspective of the AUV in FIG. 11.

Figure 13:
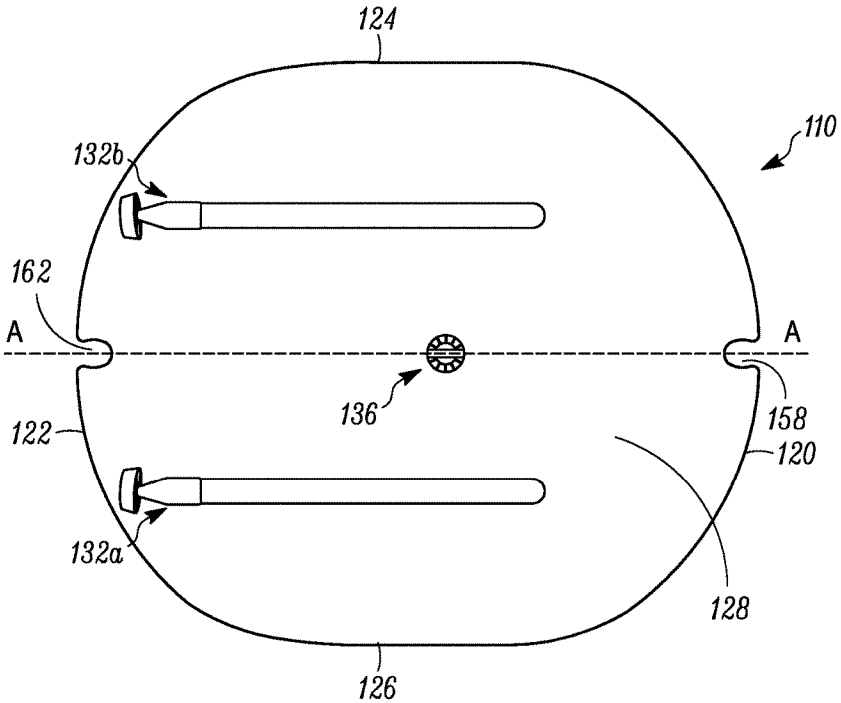

FIG. 13 is a top plan view of the AUV in FIG. 11.

Figure 14:
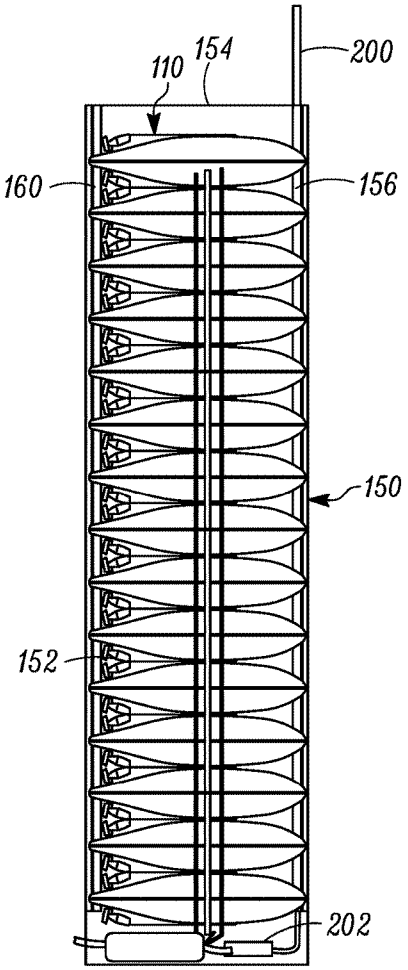

FIG. 14 is a side view of a plurality of the AUVs of FIG. 11 stacked within a missile launch tube.

Figure 15:
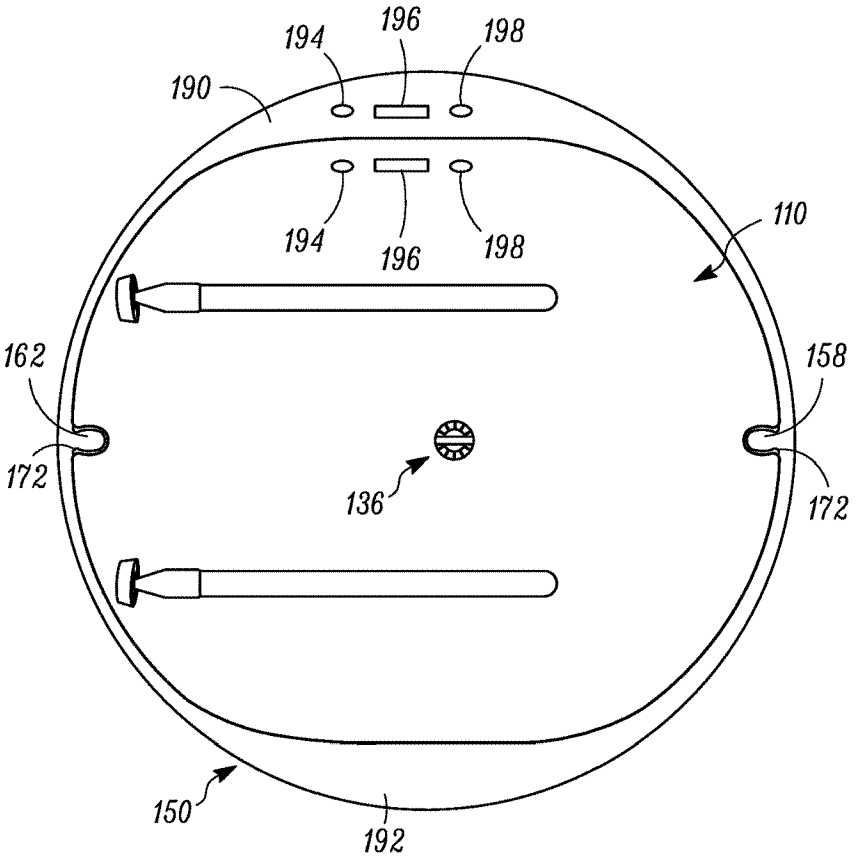

FIG. 15 is a top view of FIG. 14.

Figure 16:
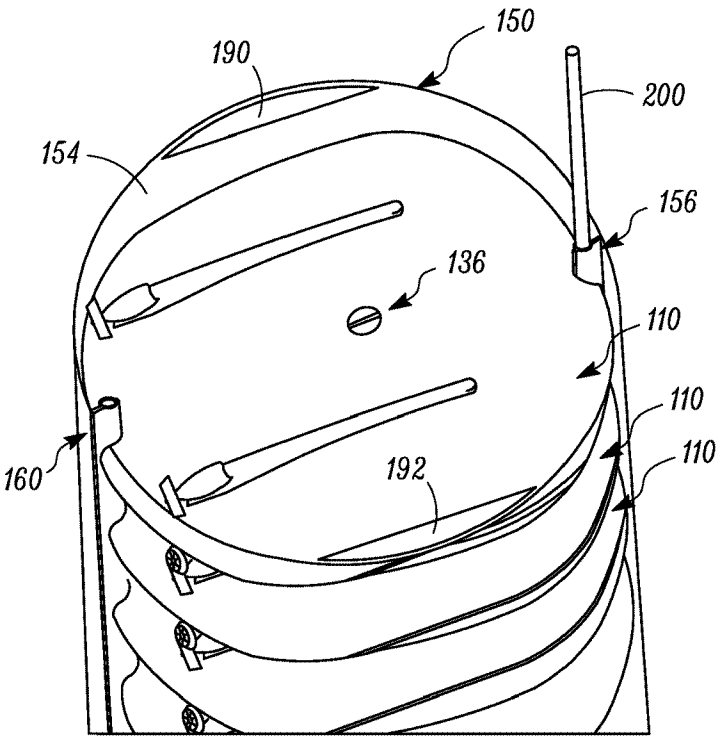

FIG. 16 is a perspective view of the stacked AUVs of FIG. 14 within the missile launch tube.

Figure 17:
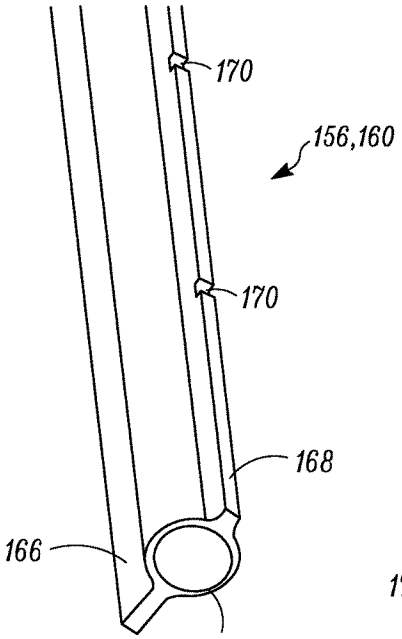

FIG. 17 is a perspective view of a portion of an AUV support rail used in the missile launch tube.

Figure 18:
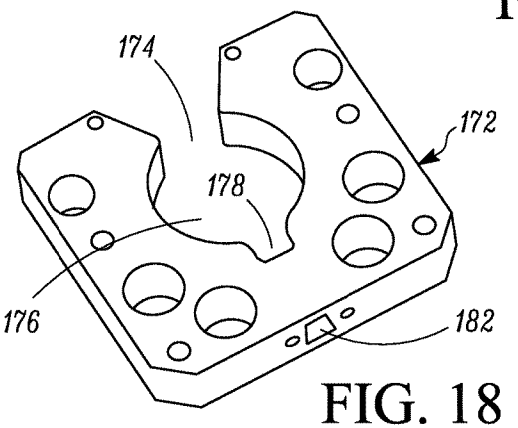

FIG. 18 is a perspective view of a clip used on the AUV.

Figure 19:
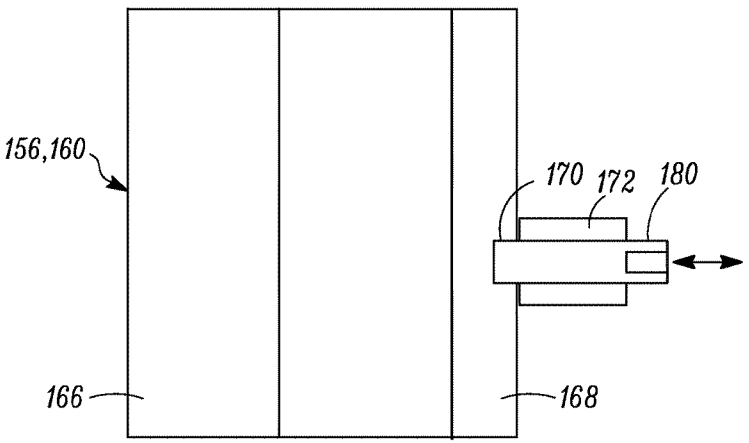

FIG. 19 is a cross-sectional side view showing interaction between the AUV support rail and the clip on the AUV to releasably secure the AUV to the support rail.

FIGS. 20A-E illustrate an example launch sequence of an AUV from the missile launch tube of FIG. 14.

DETAILED DESCRIPTION

AUVs are described that can operate in an independent manner, or that can operate together with other similarly configured AUVs. The AUVs can be deployed into the water from any vehicle including aerial, surface and/or sub-surface vehicles. In one embodiment, the AUVs can be stacked with other AUVs in a missile launch tube of a submarine and the AUVs can be launched one-by-one, in groups, or all together from the launch tube. When launching from a missile launch tube, each AUV can be slightly positively buoyant to enable sequential launches with minimal deployment apparatus, and to protect the missile hatch from damage. A releasable attachment mechanism can be provided, for example between the stacked AUVs or between the AUVs and the missile launch tube, that can be selectively released to allow each AUV to float out of the launch tube. In some embodiments, launch from a launch tube could be aided by one or more vertical thrusters on the AUV. In other embodiments, one or more of the AUVs can be carried on an exterior surface of a hull of a surface or sub-surface vehicle, such as a submarine, and launched from the vehicle.

The AUVs described herein can be described as being small and generally disk-shaped or pancake-shaped with a maximum lateral or maximum major dimension, when the AUVs are viewed from the side, that is larger than its maximum thickness when the AUVs are viewed from the side. In one embodiment, the AUVs can generally have the shape of a generally circular disk when viewed in a top view. A generally circular disk shape is convenient when the AUV is intended to be launched from a missile launch tube which tends to have a tubular shape. However, the AUVs are not limited to a circular disk shape, and other shapes including, but not limited to, polygonal and irregular shapes when viewed in a top view, having a major dimension that is greater than the thickness could be used.

Figure 1:
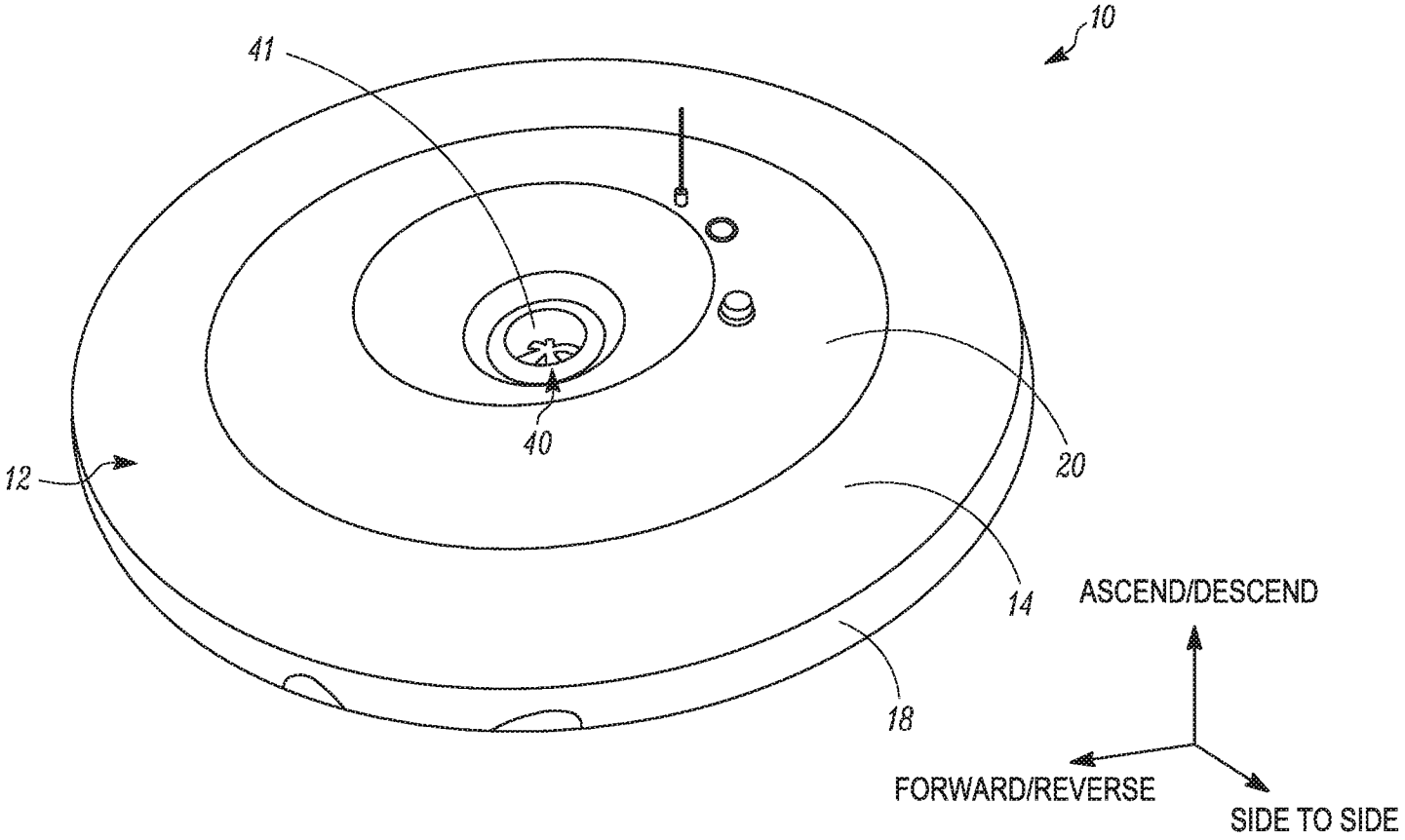
FIG. 1 is a perspective view of one example of an AUV described herein.
Figure 2:
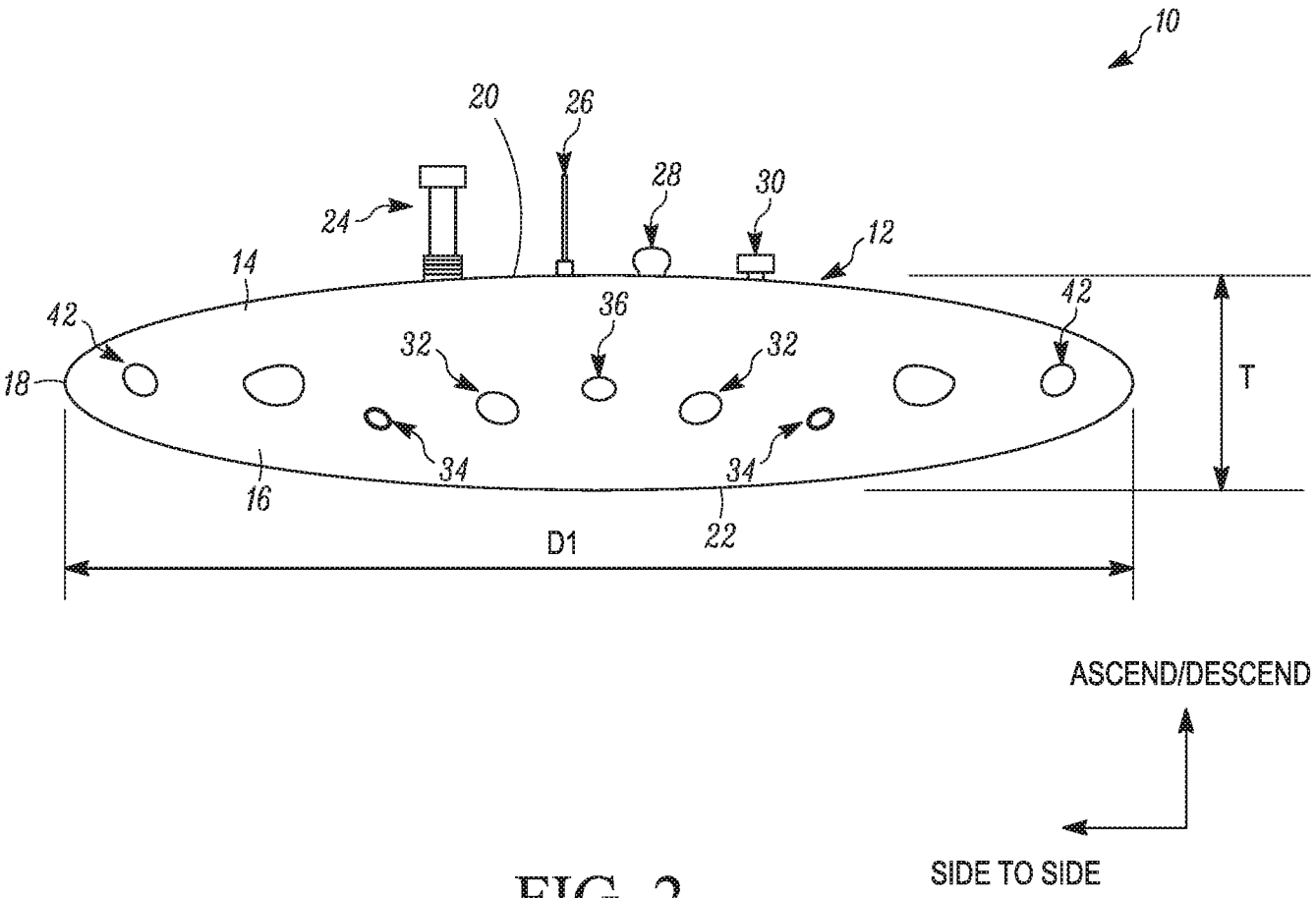
FIG. 2 is a side view of the AUV of FIG. 1.

Referring to FIGS. 1 and 2, one example of an AUV 10 is illustrated. The AUV 10 includes a hull 12 that can be formed of any materials suitable for underwater use including metals and plastics. The hull 12 is generally disk-shaped in that it has a major dimension D1 when viewed in a side view of the AUV 10 (as in FIG. 2) that is greater than a thickness T of the AUV 10 when viewed in the same side view. The thickness T and the major dimension D1 are of the hull 12 itself and do not include any protruding elements such as antennas, periscopes or control surfaces. In the example illustrated in FIGS. 1-2, the AUV 10 has the shape of a substantially circular disk. However, other non-circular disk-shapes can be used as described further below.

In one non-limiting example, the AUV 10 can have a major dimension D1 or diameter of about 2.0 meters and the thickness T at the thickest part of the AUV 10 can be approximately 1.0 meter or less. As will be discussed further below, the shape of the AUV 10 is useful for launching the AUV 10 from a suitable launch platform, for example a missile launch tube of a submarine, either by itself or with other similarly configured AUVs. In one embodiment discussed further below, up to twelve or more of the AUVs can be stacked on top of one another in the missile launch tube. It is to be realized that non-circular disk shaped AUVs could also be stacked in and launched from a missile launch tube as well. In addition, the AUVs can be stacked in the launch tube in direct contact with one another, or the AUVs can be stacked where the AUVs are not in direct contact with one another but instead there is a space between the AUVs in the launch tube with edges of the AUVs being held by the launch tube in the spaced, stacked arrangement.

Returning to FIGS. 1-2, the hull 12 has an upper half 14, a lower half 16, and a perimeter edge 18 where the upper half 14 meets the lower half 16. The upper half 14 is generally dome-shaped and is continuously convexly curved from the edge 18 to a central, substantially flat portion 20. The lower half 16 is also generally dome-shaped and is continuously convexly curved from the edge 18 to a central, substantially flat portion 22. The flat portions 20, 22 facilitate stacking of the AUV 10 with other similarly configured AUVs.

The AUV 10 can be provided with various sensors and other equipment depending upon the desired mission of the AUV 10. For example, with reference to FIG. 2, the AUV 10 can be provided with a periscope camera 24, a satellite communications antenna 26, a GPS antenna 28, and a Wi-Fi communication antenna 30. Each of the features 24, 26, 28, 30 can be located on the flat portion 20 of the upper half 14, but could be located at other locations on the AUV 10 as well. To facilitate stacking of the AUV 10, the features 24, 26, 28, 30 are preferably deployable from an initial non-deployed position within the hull 12 (or from a position not projecting beyond the exterior surface of the hull 12 that may interfere with stacking) to a deployed position (shown in FIG. 2). The AUV 10 can also be provided with one or more high definition cameras 32, one or more lights 34 such as LED lights, and a laser 36 for three-dimensional scanning. Other sensors and equipment that can be included on the AUV 10 includes, but are not limited to, side scan sonar, a doppler velocity log (DVL), a pressure transducer, an inertial navigation unit (INU), variable ballast, a strobe light, an Emergency Position-Indicating Radio Beacon (EPIRB), and an acoustic pinger. The AUV 10 can include a single one of the above described sensors and other equipment, or any number of the sensors and equipment in any combinations.

The AUV 10 is also provided with suitable propulsion mechanism for propelling the AUV 10 through the water including in a forward direction and optionally in a rearward direction as well, as well as up (i.e. ascend) and down (i.e. descend) and side to side. The propulsion mechanism can also maneuver or adjust the orientation of the AUV 10 about pitch, roll and yaw axes Any propulsion mechanism that can achieve the desired movements of the AUV 10 can be used.

Figure 3:
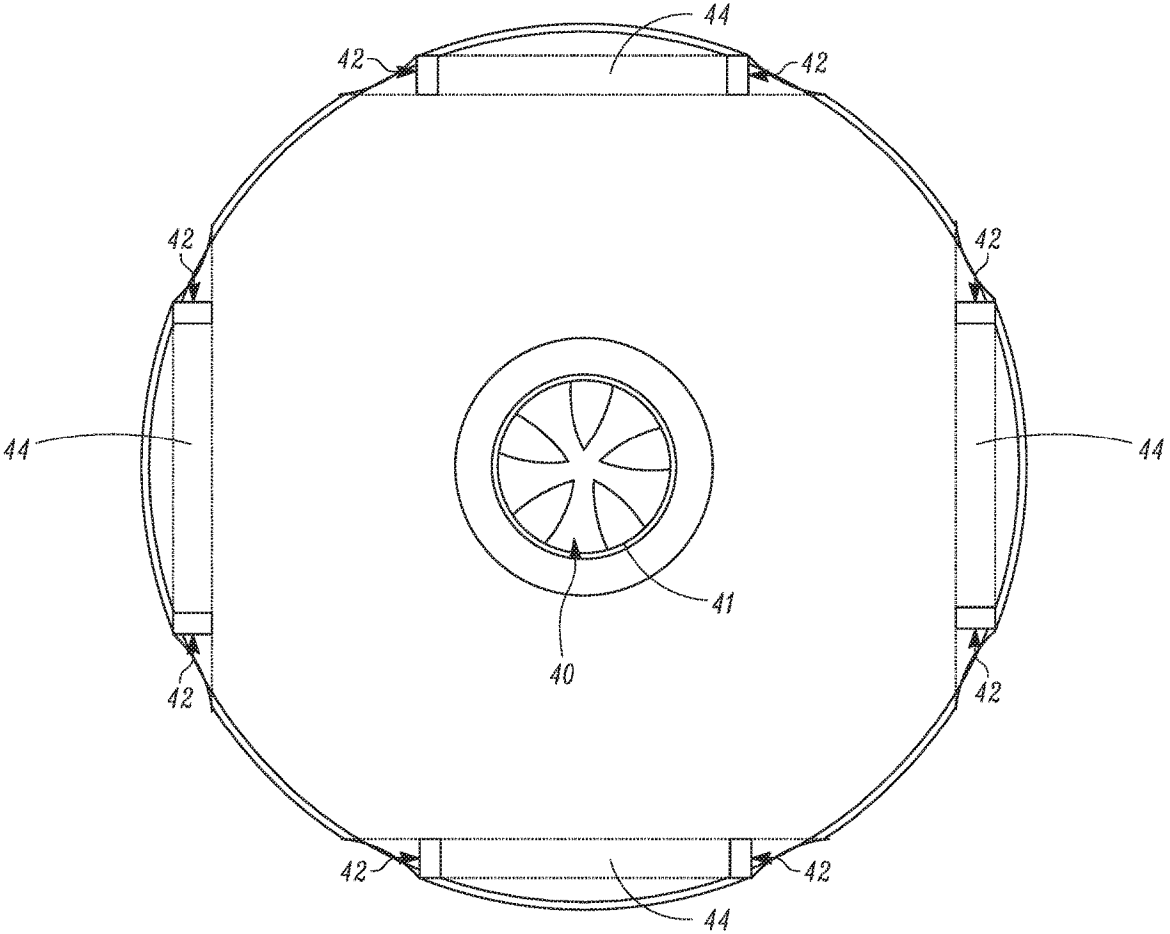
FIG. 3 is a schematic top view of the AUV of FIG. 1 showing an example of a thruster arrangement that can be used on the AUV.

Referring to FIGS. 1-3, the AUV 10 is illustrated as having a single central vertical thruster 40 for vertical propulsion that helps to control vertical (i.e. ascend/descend)

movements of the AUV 10. The vertical thruster 40 is disposed in a central duct 41 of the AUV 10 that extends through the entire thickness of the hull 12. In this example, the vertical thruster 40 can be located at the geometric center of the AUV 10. In addition, the AUV 10 is illustrated as having a plurality of side thrusters 42 that help to provide horizontal propulsion by controlling forward (and optional reverse) movements and side-to-side movements. The side thrusters 42 are disposed in ducts 44 that are located at the perimeter edge 18 of the hull. In the illustrated example, there are two of the thrusters 42 in each duct 44 for a total of eight side thrusters 42. The eight side thrusters 42 enable the AUV 10 to spin on its center axis and maneuver in tight spaces or operate a smooth controlled turn. All of the thrusters 40, 42 are disposed within the boundary defined by the perimeter edge of the AUV 10, i.e. the thrusters 40, 42 do not project beyond the perimeter edge of the AUV 10.

However, many other arrangements of propulsion mechanisms can be utilized. For example, with reference to FIGS. 4, 5*a* and 5*b*, an AUV 50 is illustrated that can be considered disk-shaped and that has two lateral thrust ducts 52*a*, 52*b* disposed on opposite sides of a central axis of the AUV 50, with each duct including at least one propulsion device within the duct 52*a*, 52*b*. The AUV 50 also includes a deployable tail 52 that functions as a control surface for directional control of the AUV 50 as it travels through the water. The deployable tail 52 has an initial non-deployed position shown in FIG. 5*a* where the tail 52 is folded and stored in a channel 54 formed in the hull of the AUV 50. The tail 52 can be spring-loaded toward a deployed position shown in FIG. 4 or the tail 52 can otherwise be actuated to the deployed position. The tail 52 can be controllably released allowing it to deploy to the deployed position. The tail 52 can include a horizontal flap surface 56 and a vertical rudder surface 58. The orientation or angle of each of the surfaces 56, 58 can be controlled by one or more actuators to provide complete directional control of the AUV 50 in the water.

In another example propulsion mechanism, a single propulsion device (not illustrated) can be provided that is disposed with a duct (not illustrated) where the flow of water created by the propulsion device can be controlled to flow aft, forward, down, left and right with a louver control system and/or by changing the orientation of the duct. Many other propulsion mechanisms can be utilized.

The AUV 50 can also include one or more deployable antennas 60. The antenna(s) 60 has a non-deployed position shown in FIG. 5*a* where the antenna 60 is disposed within a channel 62 formed in the hull of the AUV 50. The antenna 60 can be spring-loaded toward a deployed position (shown in FIGS. 4 and 5*b*) where the antenna 60 projects above the surface of the hull. In one embodiment, the antenna 60 can be held in the non-deployed position by the tail 52, in particular by the flap surface 56, which overlays the channel 62 when the tail 52 is at the non-deployed position. When the tail 52 is deployed to the deployed position, the channel 62 is uncovered allowing the antenna 60 to deploy upward to the deployed position. In other embodiments, the antenna 60 can be actuated to the deployed position using an actuator instead of being spring-loaded.

FIGS. 4 and 5*a* also illustrate an example of a lifting eye 64 that can be provided on the AUV 50 to aid in lifting the AUV 50 from the water if the AUV 50 is to be recovered and/or for towing the AUV 50 through the water. The lifting eye 64 can be located anywhere on the hull of the AUV 50 that permits attachment of a lifting hook for lifting the AUV 50 or attachment of a tow line. A similar lifting eye can be used on the other AUVs described herein as well.

Power for powering the various power consuming elements of the various AUVs described herein can be provided by one or more batteries provided on the AUV. In embodiments where the AUV is intended to be recoverable after a mission, the batteries can be rechargeable or the batteries can be replaced.

In some embodiments, the AUVs described herein can have positive buoyancy or can have controllable buoyancy so as to be made positively buoyant so that the AUV has a tendency to rise upwardly in the water. The positive buoyancy would facilitate a passive upward deployment of the AUV and provides a failsafe so that the AUV will rise to the surface if there are any failures. In some embodiments the buoyancy can be changed to increase or decrease the buoyancy. In addition, the AUV can be controllably scuttled to cause the AUV to sink to the ocean floor.

The AUVs described herein can be deployed into the water from any vehicle including aerial, surface and/or sub-surface vehicles. In one embodiment, one or more of the AUVs described herein can be detachably affixed to the exterior surface of a hull of a vehicle, such as a submarine. The submarine carries the AUV as it travels through the water, and once a designated point is reached, the AUV can be released to perform its intended mission.

With reference to FIGS. 6 and 7, in another embodiment the AUVs described herein can be carried in and deployed from a launch platform, in this example a missile launch tube 70 of a submarine 72. FIG. 6 illustrates an example of the submarine 72 with a hatch 74 of one of the missile launch tubes 70 opened. A plurality of the AUVs 10 (or the AUVs 50) are shown outside the hull of the submarine 72 after being released from the launch tube 70.

FIG. 7 shows a plurality of the AUVs 10, 50 disposed within the launch tube 70 prior to launch. The AUVs are stacked on top of each other with each AUV being detachably connected to its adjacent AUV as discussed further below. Any number of the AUVs can be stacked within the launch tube 70. In one non-limiting example, twelve of the AUVs can be stacked within the launch tube 70 waiting to be launched. To prevent damage to the interior of the launch tube 70, a sleeve or liner 76 can be provided in the launch tube 70. However, the sleeve 76 is optional.

The launch tube 70/sleeve 76 and the perimeter edge 18 are sized relative to one another so that the perimeter edge 18 contacts the walls of the launch tube 70/sleeve 76 for lateral support. When the AUV is to be deployed from the missile launch tube 70, the perimeter edge 18 can also be rounded which helps the AUV float upward in the launch tube 70/sleeve 76 during launch without jamming in the launch tube 70/sleeve 76.

To launch one of the AUVs from the launch tube 70, the hatch 74 is opened and the launch tube 70 is flooded with water. The uppermost AUV in the stack is disconnected from the AUV beneath it. Due to the positive buoyancy of the AUV, the AUV floats upward in the launch tube 70 until it clears the launch tube 70 and free of the hull of the submarine. The propulsion mechanism of the AUV can then engage to propel the AUV on its intended mission. The vertical thrust capability (if provided) of the AUV can also be used to help the AUV rise upwardly in the launch tube.

FIGS. 8 and 9 are side cross-sectional views of the AUVs 10, 50 as they would be stacked in the launch tube, with the launch tube removed for clarity. FIGS. 8 and 9 illustrate one example of a releasable connection between the AUVs that secures the AUV to one another while in the stack and that can be actuated to release each AUV. Any releaseable connection between the AUVs can be used. The releasable connection is one that permits the connection to be automatically and remotely released (i.e. remotely and without direct human physical manipulation of the securing mechanism).

In the example illustrated in FIGS. 8-9, each AUV includes a female slot 80 formed in the bottom thereof, for example near the center of the AUV. Each AUV also includes a male protrusion 82 that is designed to fit within the female slot 80 of the AUV above it. Each male protrusion 82 includes an opening 84 therein through which a pin 86 of a solenoid actuator 88 can extend. The solenoid actuator 88 and pin 86 are arranged on the AUV adjacent to the female slot 80. As shown in the bottom portion of FIG. 9, when the AUVs are stacked, the male protrusion 82 is disposed within the female slot 80 and the actuator 88 is actuated to extend the pin 86 so that the pin 86 extends through the opening 84 in the male protrusion 82 locking the AUVs together. As shown in the top portion of FIG. 9, to deploy the uppermost AUV, the actuator 88 can be actuated remotely to retract the pin 86, thereby removing the pin 86 from the opening 84, and releasing the upper AUV allowing it to float upwardly in the launch tube. A plate 90 having one of the male protrusions 82 can be provided in the bottom of the launch tube 70 for use in securing the bottommost AUV in the stack. In addition to helping the secure the AUVs in the stack, the male protrusion 82 can also function as a lifting bail for lifting the AUV from the water at the end of a mission using a crane or other lifting mechanism and/or for attaching a tow line to the AUV for towing the AUV.

FIG. 10 illustrates an example of an AUV 10, 50 that is configured to, as part of its mission, attach to the hull of a structure 100 such as a ship or submarine hull, a support leg of a drilling platform, or any other structure. In this example, a flexible, circumferentially continuous skirt 102 can be provided on the bottom of the AUV 10, 50. The AUV 10, 50 can carry a water pump 104 with an intake line 106 connected to the area bounded by the skirt 102 and a discharge line 108 leading to ambient. To attach to the structure 100, the AUV 10, 50 maneuvers itself adjacent to the structure 100 until the skirt 102 contacts the structure 100. The pump 104 is then activated to pump water from the region bounded by the skirt 102. This creates a suction force maintaining the AUV 10, 50 connected to the structure 100. If it is desired to release the AUV 10, 50 from attachment to the structure 100, the pump 104 is stopped, and imperfections in the sealing engagement between the perimeter of the skirt 102 and the surface of the structure 100 permits water to flood into the space, releasing the vacuum and allowing the AUV 10, 50 to release. The surface of the structure 100 to which the AUV 10, 50 attaches can be flat, curved, uneven, and the like. The surface can take any form as long as s sufficient vacuum can be created between the skirt 102 and the surface of the structure 100.

FIGS. 11-13 illustrate another example of an AUV 110 that can be used like the other AUVs described herein, for example arranged in a stacked arrangement in a suitable launch platform such as a missile launch tube of a submarine and then launched, or carried and launched by itself. The AUV 110 is substantially flat or disk-shaped or pancake-shaped whereby the AUV 110 has a maximum lateral or maximum major dimension when viewed from the side that is significantly larger than its maximum thickness or height when viewed from the side. For example, in one non-limiting example, the maximum lateral dimension of the AUV 110 could be about 3-4 times greater than the maximum height. The AUV 110 is positively buoyant, or can be made to be positively buoyant via a controllable buoyancy system.

The AUV 110 includes a hull 112 that can be formed of any materials suitable for underwater use including metals and plastics. The hull 112 has an upper half 114, a lower half 116, and a perimeter edge 118 where the upper half 114 meets the lower half 116. When viewed from the top (as in FIG. 13) or from the bottom, the perimeter edge 118 of the AUV 110 has a curved leading edge 120, a curved trailing edge 122, a first linear or straight side edge 124 interconnecting the curved leading edge 120 and the curved trailing edge 122, a second linear or straight side edge 126 opposite the first side edge 124 and interconnecting the curved leading edge 120 and the curved trailing edge 122 on the opposite side of the AUV 110, an upper major surface 128, and a lower major surface 130.

The AUV 110 further includes two propulsion thrusters 132*a*, 132*b* for horizontal propulsion on the upper major surface 128 adjacent to the aft end thereof, with the two thrusters 132*a*, 132*b* equidistantly disposed on opposite sides of a principle axis A-A extending between the curved leading edge 120 and the curved trailing edge 122 bisecting the AUV 110. The AUV 110 further includes two propulsion thrusters 134*a*, 134*b* for horizontal propulsion on the lower major surface 130 adjacent to the aft end thereof, with the two thrusters 134*a*, 134*b* disposed equidistantly on opposite sides of the principle axis A-A and positioned opposite the thrusters 132*a*, 132*b*. The thrusters 132*a*, 132*b*, 134*a*, 134*b* are disposed within the boundary defined by the perimeter edge 118, i.e. the thrusters 132*a*, 132*b*, 134*a*, 134*b* do not project beyond the perimeter edge 118.

In addition, the AUV 110 includes a single vertical thruster 136 that extends vertically through the hull 112 of the AUV 110 from the bottom major surface 130 to the top major surface 128 for vertical propulsion of the AUV 110. A central axis B-B of the vertical thruster 136 intersects the principle axis A-A. The geometric location of the vertical thruster 136 on the AUV 110 can vary. For example, in one embodiment, the vertical thruster 136 can be located at the center of gravity and center of buoyancy of the AUV 110, which can be located forward from the geometric center of the AUV 110. This allows hovering of the AUV 110 with reduced or little input from the thrusters 132*a*, 132*b*, 134*a*, 134*b* located near the aft end of the AUV 110. However, other geometric positions of the vertical thruster 136 are possible.

The AUV 110 can be provided with various sensors and other equipment depending upon the desired mission of the AUV 110, such as various combinations of a camera, a satellite communications antenna, a GPS antenna, a Wi-Fi communication antenna, one or more lights such as LED lights, a laser for three-dimensional scanning, side scan sonar, a doppler velocity log (DVL), a pressure transducer, an inertial navigation unit (INU), variable ballast, a strobe light, an Emergency Position-Indicating Radio Beacon (EPIRB), and an acoustic pinger. The AUV 110 can include a single one of the above described sensors and other equipment, or any number of the sensors and equipment in any combinations.

Referring to FIGS. 14-16, a plurality of the AUVs 110 are illustrated as being arranged in a stacked configuration within a launch platform such as a missile launch tube 150 of a submarine (visible in FIG. 6). As would be understood by a person of ordinary skill in the art, the launch tube 150 is formed in the hull of the submarine, and the launch tube 150 defines an interior space 152 with a vertically uppermost exit opening 154 that is opened and closed by a hatch such as the hatch 74 discussed above in FIG. 6. In a standard launch orientation of the submarine, the launch tube 150 is considered to be vertical or substantially vertical.

The AUV 110 is sized such that a plurality of the AUVs 110 can be arranged in a vertical stacked configuration within the launch tube 150. In one embodiment, at least three of the AUVs 110 can be stacked within the launch tube 150. In the example illustrated in FIG. 14, there are 15 of the AUVs 110 vertically stacked within the launch tube 150.

In FIGS. 14-16, the AUVs 110 are secured to the missile tube 150 rather than to one another as described above with respect to FIGS. 8 and 9. When it is time to launch the uppermost AUV 110 in the stack, the securement between the uppermost AUV 110 and the launch tube is released. The positive buoyancy of the AUV 110 then allows the AUV to float up and out of the launch tube 150. Each of the AUVs 110 can be launch individually, or the AUVs 110 can be launched in groups or all together from the launch tube 150.

Any releasable securement mechanism between the AUVs 110 and the missile launch tube 150 can be used. For example, in the illustrated example, a rail system is provided in the launch tube 150. The rail system includes a forward rail 156 disposed in the launch tube 150 that is engageable within a forward notch 158 formed in the leading edge 120 of the AUV 110, and rear rail 160 disposed in the launch tube 150 that is engageable within a rear notch 162 formed in the trailing edge 122 of the AUV 110. In FIG. 15, the rails 156, 160 are removed for clarity. A releasable connection mechanism is provided between the AUVs 110 and the rails 156, 160 to releasably secure the AUVs 110 to the rails 156, 160. When the releasable connection mechanism is released, the AUV 110 is freed from the rails 156, 160, allowing the AUV 110 to slide up the rails 156, 160 due to the positive buoyancy and out of the launch tube 150.

Further details on the rails 156, 160 and the releasable connection mechanism are shown in FIGS. 17-19. A portion of the one of the rails 156, 160 is shown in FIG. 17. Each rail 156, 160 extends the length of the launch tube 150 and includes a central hollow tube 164, a rear flange 166, and a front flange 168. The rails 156, 160 are each arranged so that the rear flange 166 faces the inner wall of the launch tube 150 and the front flange 168 faces the AUVs 110. The rear flange 166 is fixed to the launch tube 150 thereby fixing the rail 156, 160 to the launch tube 150. The front flange 168 of each rail 156, 160 includes a plurality of spaced notches 170 formed therein along the length thereof that interact with a releasable lock on the AUVs 110 to releasably lock the AUVs 110 to the rails 156, 160.

Referring to FIG. 18, a clip 172 is provided within each of the forward notch 158 and the rear notch 162 of the AUVs 110. The clip 172 defines a chamfered slot 174 leading to a central opening 176 and an opposite slot 178 disposed opposite the slot 174. As best seen in FIGS. 14, 16 and 19, the hollow tube 164 of the rails 156, 160 is sized so as to be slidably disposed within the central opening 176 of the clip 172, while the front flange 168 is sized to be disposed within the slot 178. A solenoid (not shown) is associated with each of the clips 172, with the solenoid able to extend and retract a pin 180 (seen in FIG. 19) via an opening 182 in the clip 172 to engage within and retract from the notches 170. When the pin 180 is extended by the solenoid (i.e. to the left in FIG. 19), the ends of the pins 180 extends into the notches 170 in the front flanges 168 of the rails 156, 160 to lock the AUV 110 to the rails 156, 160. When the pins 180 are retracted by the solenoids (i.e. retracted to the right in FIG. 19), the ends of the pins 180 are removed from the notches 170 thereby releasing the AUV 110 from the rails 156, 160 and allowing the AUV 110 to slide up the rails 156, 160.

Returning to FIGS. 14-16, the sides of the launch tube 150 facing the straight sides edges 124, 126 of the AUVs 110 are made flat to define hollow conduits 190, 192 on each side of the launch tube 150. The conduits 190, 192 can be used to run electronics and/or other elements up the sides of the launch tube 150. For example, referring to FIGS. 14 and 15, in one embodiment the AUV 110 can include a Hall Effect sensor 194, a communications antenna 196 and an electro-magnet 198 near the first side 124 thereof. A corresponding Hall Effect sensor 194, communication antenna 196 and electro-magnet 198 can be run up through the conduit 190 of the launch tube 150. The magnetic Hall Effect sensors 194 can be used to detect when the AUV 110 is present. The electro-magnet 198 can be used to "wake-up" the AUV 110 prior to launch. The communications antennas 196 permit communications with the AUV 110. One or more of the conduits 190, 192 can also be used to run wireless power transfer equipment for charging the AUV 110, fiber optic tethers for data transfer, and for operating one or more camera and lights at the top of the launch tube 150.

In addition, referring to FIGS. 14 and 16, the forward rail 156 can include a coaxial rail extension 200 that can be telescoped into and out of the rail 156 to extend out of the launch tube. A similar rail extension can be provided in the rear rail 160 as well. The rail extension 200 is slidably disposed within the hollow tube 164, and the extension and retraction of the rail extension 200 is controlled by a suitable extension/retraction mechanism, for example by a high pressure water pump 202 that pumps water into the hollow tube 164 to extend the rail extension 200 upwardly out of the rail 156 and out of the launch tube 150 as shown in FIGS. 14 and 16, or evacuates water from the hollow tube 164 to retract the rail extension 200 back into the hollow tube 164 of the rail 156.

The sleeve or liner 76 discussed above in FIG. 7 could also be used in, and can be considered to form part of, the launch tube 150. The rails 156, 160 and all supporting equipment for the AUVs 110 can be disposed within the sleeve or liner 76. The outside of the sleeve or liner 76 (or a portion thereof) can match any existing interfaces of the launch tube 150. The use of the sleeve or liner 76 can be used to package the AUVs 110 as a self-contained payload for the launch tube of the submarine.

Figure 20B:
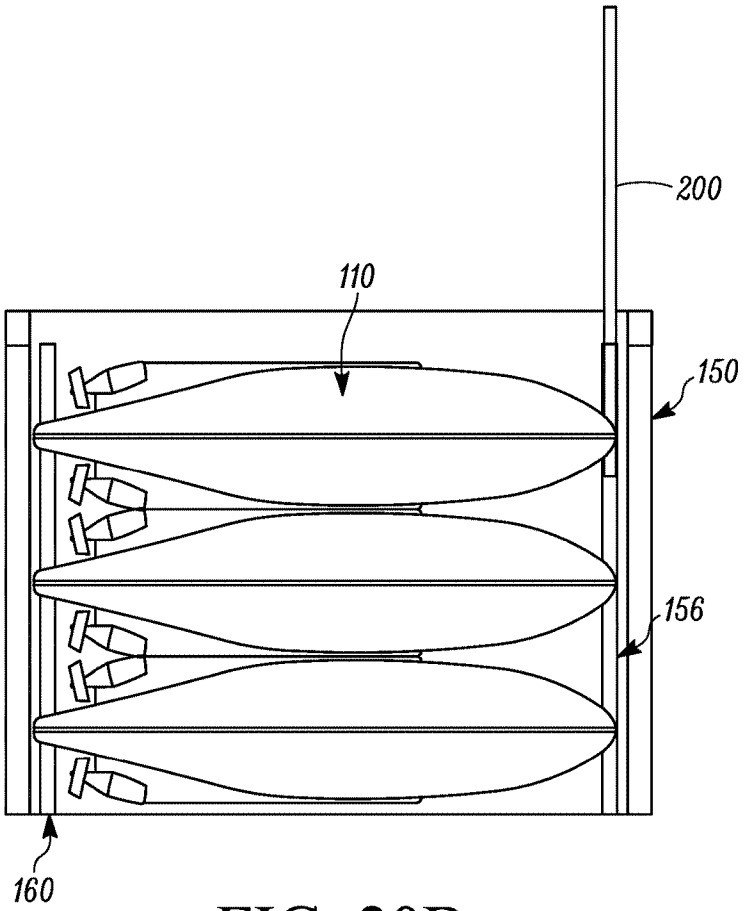
Figure 20A:
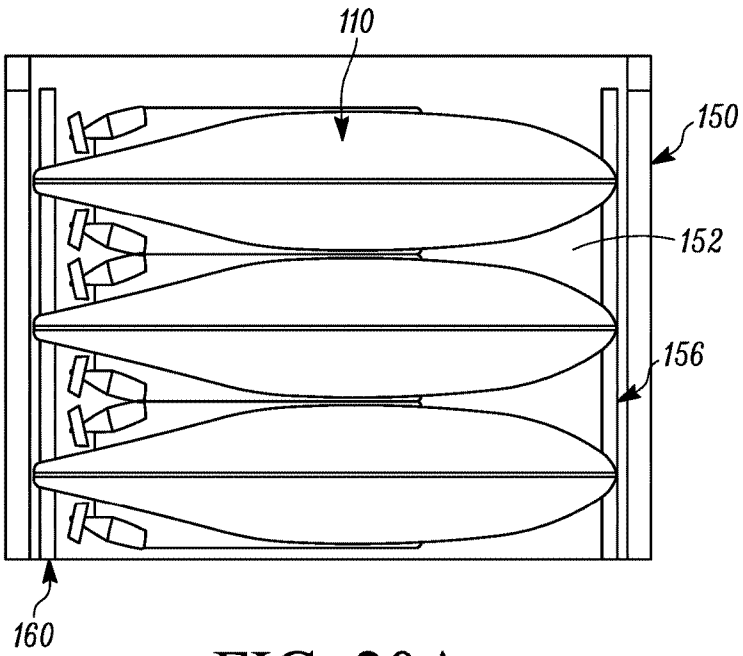

Referring to FIGS. 20A-E, an example launch sequence using the AUV 110 and the missile launch tube 150 is illustrated. In FIGS. 20A-E, only an upper portion of the launch tube 150 is illustrated. In FIG. 20A, the uppermost AUV 110 in the stack is ready for launch. The launch tube 150 is flooded with water and the hatch (not shown) of the missile launch tube 150 is opened. In FIG. 20B, the rail extension 200 is then extended upward and a launch command is then transmitted to the uppermost AUV 110. The uppermost AUV 110 can record the initial depth and heading thereof. In addition, the releasable connections between the uppermost AUV 110 and the rails 156, 160 are released.

Figure 20D:
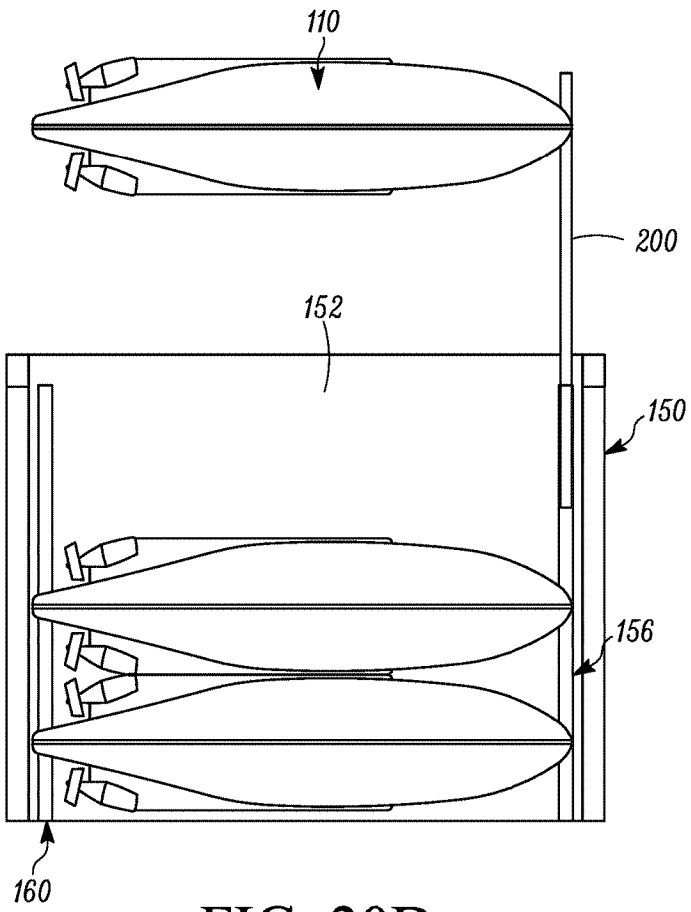
Figure 20C:
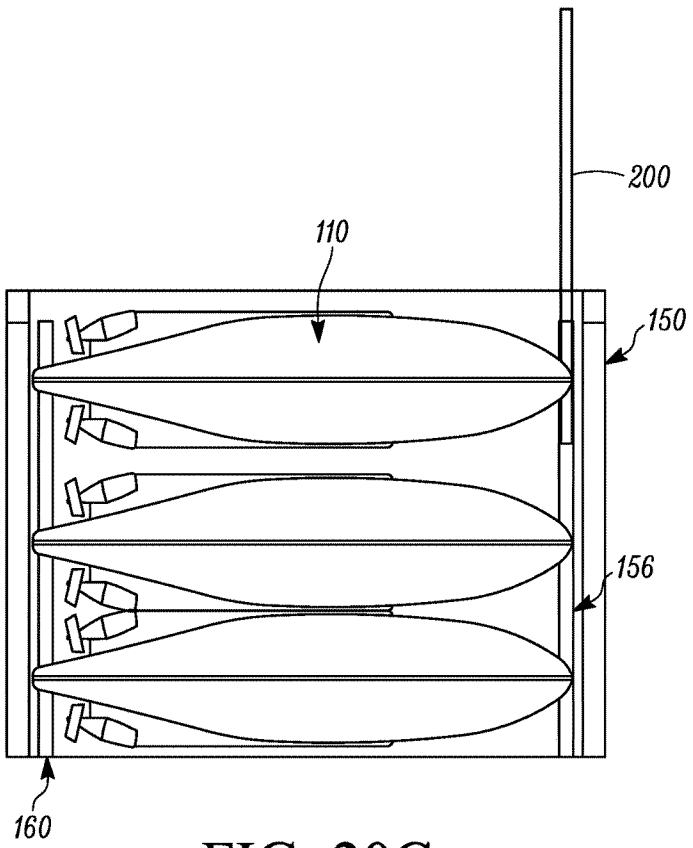

Referring to FIG. 20C, once the releasable connections are released, the AUV 110 starts to float upwardly along the rails 156, 160 due to the positive buoyancy of the AUV 110. The remaining AUVs 110 remain secured to the rails 156, 160 by their releasable connections. Optionally, the vertical thruster 136 can be used to supplement the upward velocity of the AUV 110. In addition, one or more of the horizontal thrusters 132*a*, 132*b*, 134*a*, 134*b* can be used to help maintain a desired pitch and/or heading of the AUV 110 as the AUV 110 ascends along the rails 156, 160.

Referring to FIG. 20D, as the AUV 110 continues to ascend, the trailing edge 122 of the AUV 110 clears the rail 160 and the AUV 110 exits the interior space of the launch tube 150. The notch 158 at the leading edge 120 of the AUV 110 continues to be engaged with the rail extension 200. Optionally, the vertical thruster 136 can be used to supplement the upward velocity of the AUV 110. In addition, one or more of the horizontal thrusters 132*a*, 132*b*, 134*a*, 134*b* can be used to help maintain a desired pitch and/or heading of the AUV 110.

Figure 20E:
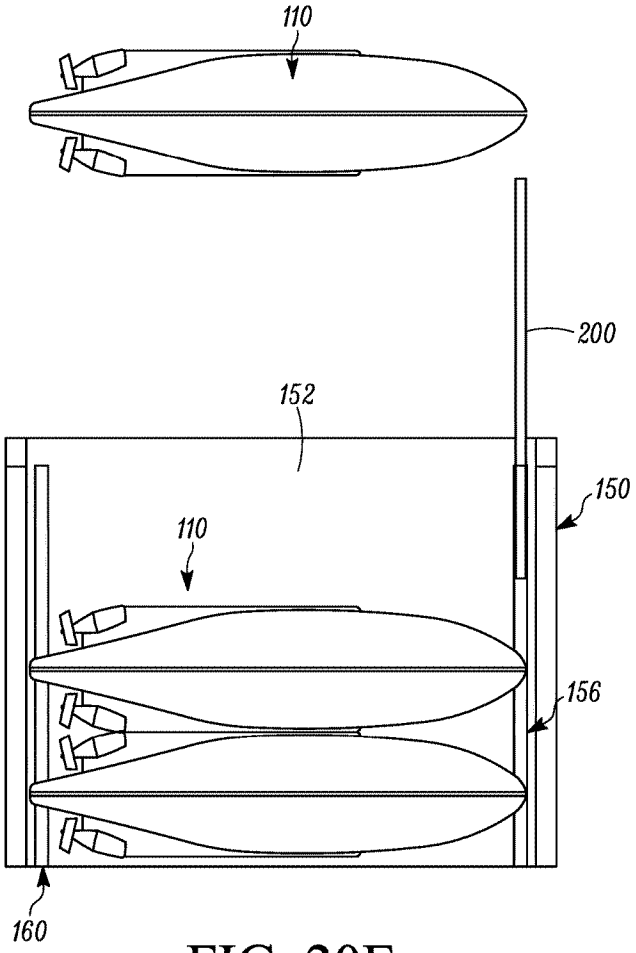

Referring to FIG. 20E, as the AUV 110 ascends further, the AUV 110 slips off of the rail extension 200 and is now free in the water and can be propelled in a desired direction and begin its intended mission. Optionally, the next uppermost AUV 110 in the stack can then be launched using a similar launch sequence.

The AUVs described herein can be used individually or independently to conduct a desired mission. The AUVs described herein can also be used with other similar AUVs in extensible networks to gather and transmit ISTAR awareness. In addition, the AUVs can form underwater swarms that can be used for numerous missions.

The AUVs described herein can have a telescoping periscope camera for information, surveillance, target acquisition, and reconnaissance (ISTAR) capability. The AUVs can also have, or can be made to have, positive buoyancy. Positive buoyancy can allow the AUVs to float up and out of the missile launch tube, as well as allow the AUVs to float to the surface and communicate with a satellite or back to a submarine or other vehicle. The AUVs can also have a Global Positioning System (GPS) antenna and can communicate its position, and be tracked by a control center in a host vehicle. The AUVs can also be equipped with one or more high definition cameras and a light system allowing the AUVs to photograph objects in the water or on the ocean floor. Once the AUV is on the surface of the water, it can transfer and communicate data with surface ships, satellites, and could be recovered by a surface ship or scuttled, depending on the mission and/or the sensor payload. The AUVs can also be equipped with forward-scanning sonar. In addition, a bracket on the bottom of the AUVs can support two side-scan sonar panels. The AUVs can also have side-scanning sonar and forward-looking sonar as well. Sensors can also be attached to a bracket underneath the AUVs if a bottom search is necessary.

The AUVs described herein are generally low cost, and they can be expendable, for example by scuttling the AUVs, at the end of their missions or recovered by a suitable recovery vehicle.

The examples disclosed in this application are to be considered in all respects as illustrative and not limitative. The scope of the invention is indicated by the appended claims rather than by the foregoing description; and all changes which come within the meaning and range of equivalency of the claims are intended to be embraced therein.

The invention claimed is:

1. A vertical missile launch tube of a submarine, comprising:

an interior space with a vertically uppermost exit opening;

a plurality of autonomous underwater vehicles within the interior space in a vertically stacked arrangement, each one of the autonomous underwater vehicles has a maximum lateral dimension that is larger than a maximum thickness dimension thereof, and each one of the autonomous underwater vehicles is sized to permit each autonomous underwater vehicle to exit the interior space through the vertically uppermost exit opening; and an actuatable, releasable connection mechanism on each one of the autonomous underwater vehicles that releasably connects each one of the autonomous underwater vehicles to the vertical missile launch tube.

2. The vertical missile launch tube of claim 1, wherein there are at least three of the autonomous underwater vehicles in the vertically stacked arrangement.

3. The vertical missile launch tube of claim 1, wherein each one of the autonomous underwater vehicles has positive buoyancy.

4. The vertical missile launch tube of claim 1, comprising a sleeve within the interior space, and the autonomous underwater vehicles are disposed within the sleeve.

5. The vertical missile launch tube of claim 1, wherein each one of the autonomous underwater vehicles includes a vertical thruster.

6. A submarine, comprising:

a hull;

a vertical missile launch tube in the hull that defines an interior space with a vertically uppermost exit opening;

a plurality of autonomous underwater vehicles within the interior space in a vertically stacked arrangement, each one of the autonomous underwater vehicles has a maximum lateral dimension that is larger than a maximum thickness dimension thereof, and each one of the autonomous underwater vehicles is sized to permit each autonomous underwater vehicle to exit the interior space through the vertically uppermost exit opening; and an actuatable, releasable connection mechanism on each one of the autonomous underwater vehicles that releasably connects each one of the autonomous underwater vehicles to the vertical missile launch tube.

7. The submarine of claim 6, wherein there are at least three of the autonomous underwater vehicles in the vertically stacked arrangement.

8. The submarine of claim 6, wherein each one of the autonomous underwater vehicles has positive buoyancy.

9. The submarine of claim 6, wherein each one of the autonomous underwater vehicles includes a vertical thruster.

* * * * *